US005549218A

United States Patent [19]

Asmussen

[11] Patent Number: 5,549,218

[45] Date of Patent: Aug. 27, 1996

[54] PAPER TOWEL DISPENSER

[76] Inventor: Hans P. Asmussen, 2620 S. Shore Dr., Milwaukee, Wis. 53207

[21] Appl. No.: 395,763

[22] Filed: Feb. 28, 1995

[51] Int. Cl.[6] ..... B65G 59/00

[52] U.S. Cl. ..... 221/282; 242/599.2

[58] Field of Search ..... 221/33, 282; 242/590, 242/598, 599.2, 607, 611, 611.2

[56] References Cited

U.S. PATENT DOCUMENTS 2,846,159 8/1958 Reynolds ..... 242/611.2

FOREIGN PATENT DOCUMENTS 1426296 12/1965 France ..... 242/599.2

*Primary Examiner*—Kenneth Noland
*Attorney, Agent, or Firm*—Michael, Best & Friedrich

[57] ABSTRACT

Spaced arms position a fixed curved guide surface in front of a roll of paper towels in about the same plane as the axis of the roll of paper. The paper can come off the top or bottom of the roll and passes over the guide surface and then goes down behind the cutter bar which extends between the lower ends of the arms. The friction of the paper passing over the curved guide surface is enhanced by having the roller which is mounted in slots in the arms pinch the paper against the curved surface. The slots are slightly longer than necessary to have the roller surface engage the paper, thus ensuring the weight of the roller will be effective.

3 Claims, 1 Drawing Sheet

PAPER TOWEL DISPENSER

FIELD OF THE INVENTION

The invention relates to paper towel holders. The usual holder discourages one handed removal of towels from the roll since it usually results in a number of towels being unwound from the roll and requiring the surplus towels to be rewound on the roll,

SUMMARY OF THE INVENTION

This invention provides a paper towel dispenser in which the roll of paper does not accelerate (or spin) when the user moves the end of the paper crosswise and away from the supply roll without manually restraining the roll. Normally this sort of action causes the paper roll to spin and feed a lot of unwanted paper toward the user. This forces the user to rewind the paper onto the roll. This invention does not overfeed the paper. This result is attained by leading the paper from the roll over a smooth curved guide surface, then down to the rear of a cutter bar. In use the paper is pulled from behind the bar and brought forward to the user. This simple path generally develops enough friction on the guide surface to attain the desired result with the better paper rolls but paper rolls of lesser quality are not as well perforated and require more force to tear a sheet from the roll. For such papers a roller is mounted for movement towards the cylinder to function somewhat in the manner of a pinch roller. This increases the friction of the paper on the guide cylinder and the dispenser operates nicely.

DETAILED DESCRIPTION OF THE DRAWINGS

Figure 1:
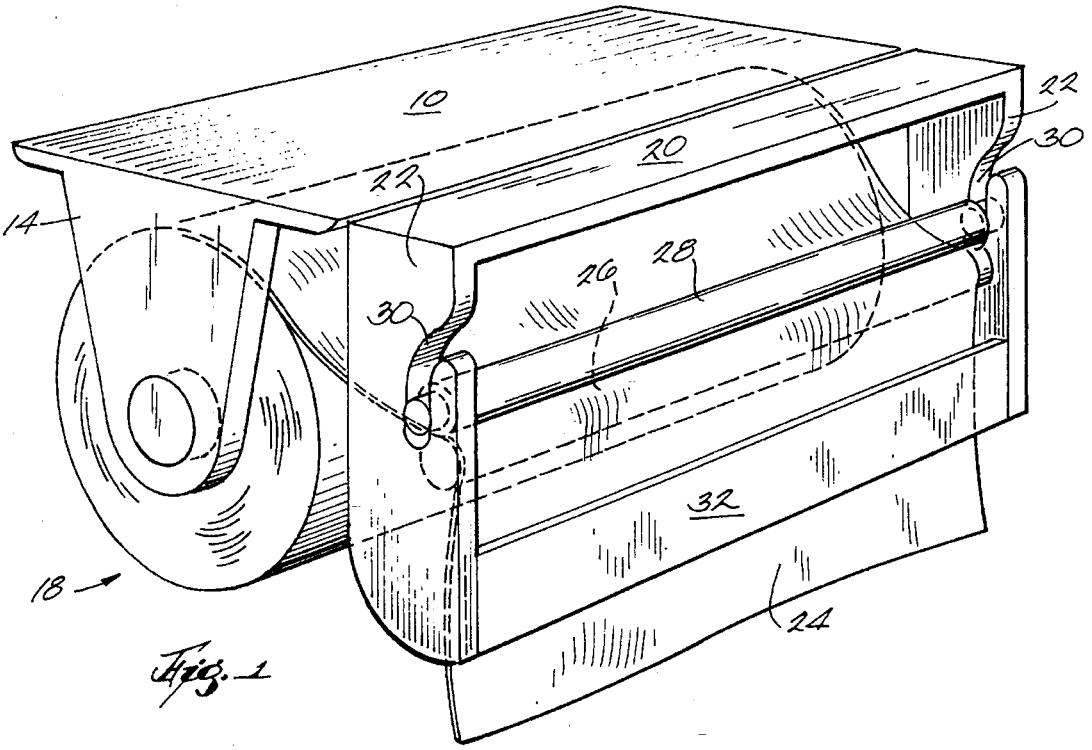
FIG. 1 is a perspective view from above and to the left of the dispenser arrangement leaving out the shelf to which the parts would be mounted but which would obscure the details of the parts.
Figure 2:
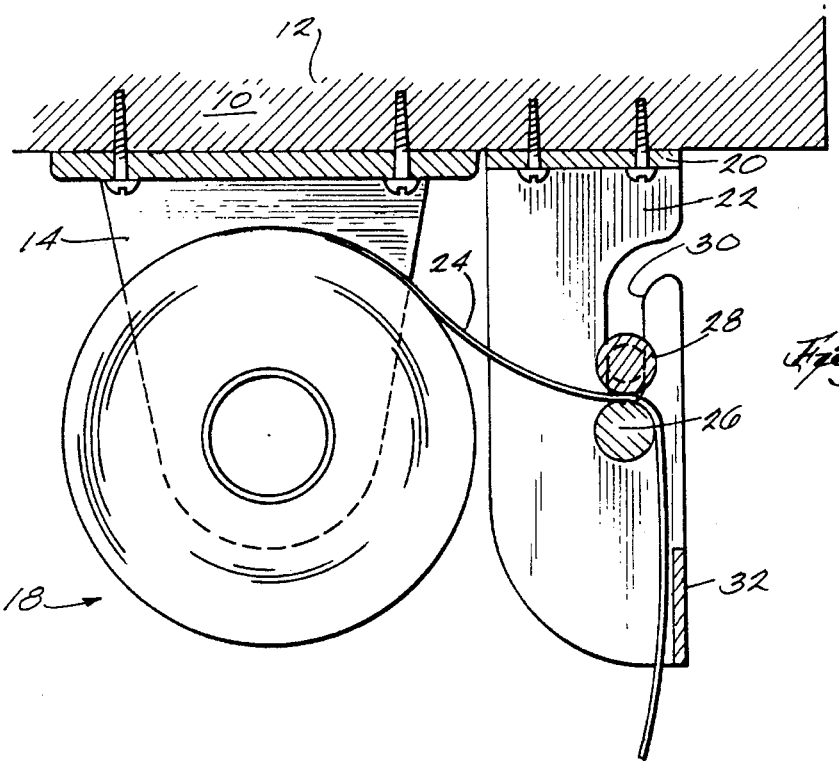
FIG. 2 is a vertical section showing some details of the parts which function to develop the desired frictional resistance to paper movement.

The paper dispenser shown in the drawings is designed for under cabinet (or shelf) use with the paper holder base 10 secured to the bottom of the cabinet or shelf 12. The base 10 has spaced supports 14 each of which has a stub shaft 16 which projects into the adjacent end of the cardboard tube on which the paper is rolled. The usual construction has the supports 14 biased to abut the ends of the roll 18. The details of the support construction are not important to this invention.

A separate base 20 is secured to the underside of the cabinet or shelf 12 and is provided with arms 22 depending in from of the paper roll 18 and spaced to allow the paper web 24 to pass between the arms 22. The arms 22 support a smooth cylindrical guide member 26 non-rotatably fixed in the arms 22 approximately in the same horizontal plane which includes the axis of the paper roll 18. The guide 26 may be integral with the arms 22 or may be fixed to the arms in any suitable manner. The guide need not necessarily be cylindrical but preferably presents a curved surface over which the paper web 24 passes. The curved surface affords maximum contact but other surface configurations may be used and are within the term "curved". The separate base 20 may be made integral with the base 10 of the paper holder if desired but the separate base allows for a little flexibility in mounting the parts. Furthermore, the separate base unit can be sold separately for use with existing towel holders. The paper web 24 can come off the paper roll 18 at the top or bottom of the roll and pass over about the same amount of surface on the cylinder.

A rotatable roller 28 is mounted in the generally vertical slots 30 in the arms so as to be free to move down in the slots 30 into engagement with the web 24 of paper passing over the cylinder 26. The slots 30 extend lower than required for the roller 28 to engage the paper web, thus ensuring maximum contact of the roller 28 with the paper so as to develop the desired friction of the paper On the cylinder. As shown in the drawings the roller axis is slightly behind the vertical plane which includes the axis of the cylinder. The degree to which the paper wraps on or engages the curved guide can be increased by moving the roller axis rearwardly. This will increase the frictional resistance to the web passing over the guide but that is not thought to be necessary or desirable. As a matter of fact, if the paper roll is of reasonably good quality it will have well defined perforations and the roller (and its attendant increase in friction) may be omitted. The surface of the guide should be smooth. If it is rough there may be too much friction.

The paper coming off the guide 26 passes down behind the cutter bar 32 which extends between the lower ends of the arms 22. The user grasps the depending paper and pulls it forwardly until the perforations have become visible. Then the paper is pulled smartly sideways and forwardly which will result in the paper separating at the perforations because there is enough friction opposing movement of the paper web over the curved guide 26 and over the back and edge of the cutter bar 32. The cutter bar does not really cut but it could be provided with cutter teeth if used with unperforated paper.

This dispenser is easy to use. The paper roll is mounted between the supports 14 in the usual way but the paper can come off the top or bottom of the roll. Whichever way the paper comes off the roll it is led over the fixed guide 26, then down behind the cutter bar 32. All that remains is to decide whether or not to use the roller 28. If it is to be used it is simply dropped into the forwardly opening upper ends of slob 30 in the arms 22. It is desireable to provide for easy mounting and removal of the roller since it is easier to service the paper roll with the roller out of the way.

As used in the claims forward means in a direction towards the user.

I claim:

1. A device for controlling resistance to removal of paper from an associated paper towel holder, comprising, a base including arms spaced far enough to allow free passage of paper toweling therebetween, a guide member extending between said arms to lie in approximately the same plane as the axis of a paper roll supported by the holder and having a surface over which the paper passes, a slot in each arm, a roller rotatably mounted in said slots and extending between said arms, said slots serving to position the roller to freely engage a paper towel between the roller and said guide member, and a bar extending between said arms below said guide member so paper coming from said surface of said guide member may pass behind said bar and be pulled against the bar when the paper is pulled briskly in a direction forwardly and transversely of the bar.

2. A device according to claim 1 in which said surface is curved and said bar has a vertically disposed rear face positioned slightly forwardly of a vertical plane including the front of said curved surface.

3. A paper towel holder and dispenser, comprising, a base, spaced supports on said base engageable with a roll of paper towels to support the roll in a horizontal position, said base including arms forwardly of said supports and spaced far apart enough to allow free passage of paper toweling therebetween, a guide member extending between said arms to lie in approximately the same plane as the axis of a paper roll supported by the holder and having a curved surface over which the paper passes, a slot in each arm, a roller rotatably mounted in said slots and extending between said arms, said slots serving to position the roller to freely engage a paper towel between the roller and said guide member, and a bar extending between said arms below said curved surface so paper coming from said curved surface of said guide member may pass behind said bar and be pulled against the bar when the paper is pulled briskly in a direction forwardly and transversely of the bar.

* * * * *